US007659814B2

(12) United States Patent
Chen et al.

(10) Patent No.: US 7,659,814 B2
(45) Date of Patent: Feb. 9, 2010

(54) METHOD FOR DISTRIBUTED SOUND COLLECTION AND EVENT TRIGGERING

(75) Inventors: Yen-Fu Chen, Austin, TX (US); John Hans Handy-Bosma, Cedar Park, TX (US); Fabian F. Morgan, Austin, TX (US); Keith Raymond Walker, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 447 days.

(21) Appl. No.: 11/379,597

(22) Filed: Apr. 21, 2006

(65) Prior Publication Data

US 2007/0275670 A1 Nov. 29, 2007

(51) Int. Cl.
*G08B 21/00* (2006.01)

(52) U.S. Cl. ..... 340/540; 340/531; 340/539.11; 340/539.14; 340/539.15; 340/573.1; 381/56

(58) Field of Classification Search ..... 340/540, 340/541, 545, 569, 573.1, 679, 531, 533, 340/539.1, 539.11, 517, 539.14–539.17, 340/539.26; 379/37–45, 51; 455/404.1; 381/56

See application file for complete search history.

(56) References Cited

U.S. PATENT DOCUMENTS

| | | | | |
|---|---|---|---|---|
| 4,117,262 | A | 9/1978 | Peecher | |
| 5,119,072 | A * | 6/1992 | Hemingway | 340/573.1 |
| 5,887,243 | A | 3/1999 | Harvey et al. | |
| 6,941,147 | B2 * | 9/2005 | Liou | 455/404.2 |
| 6,951,541 | B2 | 10/2005 | Desmarais | |
| 2003/0033144 | A1 | 2/2003 | Silverman et al. | |
| 2004/0086093 | A1 * | 5/2004 | Schranz | 379/37 |
| 2004/0253926 | A1 * | 12/2004 | Gross | 455/67.11 |
| 2005/0086366 | A1 * | 4/2005 | Luebke et al. | 709/238 |
| 2005/0232435 | A1 | 10/2005 | Stothers et al. | |
| 2005/0267605 | A1 * | 12/2005 | Lee et al. | 700/19 |
| 2006/0017558 | A1 * | 1/2006 | Albert et al. | 340/531 |
| 2006/0071784 | A1 * | 4/2006 | Frank | 340/573.1 |
| 2006/0167687 | A1 * | 7/2006 | Kates | 704/235 |
| 2007/0236344 | A1 * | 10/2007 | Desrosiers et al. | 340/539.15 |

* cited by examiner

*Primary Examiner*—Thomas J Mullen
(74) *Attorney, Agent, or Firm*—Yee & Associates, P.C.; William H. Steinberg

(57) ABSTRACT

The present invention provides a computer implemented method for sending alerts. A distributed sensor receives a sound and determines whether the sound matches a preset criterion. If so, the distributed sensor transmits an event to a central portal device.

15 Claims, 6 Drawing Sheets

401 403 405 407

*FIG. 4A*

| MICROPHONE | PATTERN | CRITERIA | DEVICE |
|---|---|---|---|
| LAUNDRY ROOM | WASHER AND DRYER | 1. WHEN WASHER SOUND STARTS AND DRYER SOUND IS NOT ON, ALERT WHEN WASHER SOUND ENDS. 2. WHEN DRYER STARTS, ALERT WHEN DRYER SOUND ENDS | BROADCAST ALERT TO ALL TVs AND COMPUTERS IN THE HOUSE |
| KITCHEN | MICROWAVE OVEN BEEP, BOILING WATER | 1. WHEN MICROWAVE OVEN BEEPS THREE TIMES. 2. WHEN LIQUID BEGINS TO BOIL | BROADCAST ALERT TO ALL TVs AND COMPUTERS IN THE HOUSE SO COOK CAN CONTINUE FOOD PREPARATION |
| DOORS | KNOCKS AND LOCK/UNLOCKS | 1. WHEN DOOR KNOCKS. 2. WHEN DOOR IS LOCKED AND UNLOCKED | BROADCAST ALERT TO ALL TVs AND COMPUTERS IN THE HOUSE. KEEP TRACK OF DOOR LOCK/UNLOCK STATUS. IF CARETAKER IS HOME WITH CHILDREN, PAGE IF DOOR IS OPENED |
| 409 NEAR A CREAKY FLOOR OR STAIR | CREAK | WHEN CREAK, ASSUMING ALERT HAS BEEN SET, SUCH AS WHILE HOUSE OWNERS ARE AWAY | CALL NEXT DOOR NEIGHBORS. PAGE FAMILY. INSTRUCT ALL MICROPHONES TO RECORD SOUNDS AND SAVE AUDIO STREAMS TO OFFSITE SERVER. AUDIO IS REQUESTED BY USER |
| ALL IN-HOUSE AND BACKYARD MICROPHONES | CHILD'S SCREAM AND CRY | WHEN SCREAM OR CRY IS DETECTED | SEND NOTICE TO CARETAKER'S PORTABLE EMAIL DEVICE. INCLUDE MICROPHONE LOCATION |
| NEAR BABY'S CRIB | CHILD'S SCREAM, CRY, BREATHING, AND VOMITING | 1. WHEN BREATHING PATTERN IS INTERRUPTED BY A PERIOD OF TIME. 2. WHEN CHILD'S SCREAM OR CRY CONTINUES FOR A PERIOD OF TIME. 3. WHEN CHILD VOMITS | FOR THE LIFE-THREATENING AND ILLNESS EVENTS, FIRE OFF ALL DEVICES. FOR CHILD'S SCREAM OR CRY, PIPE SOUND TO THE PDA OF THE ON-DUTY CARETAKER |

TO FIG. 4B

*FIG. 4B*

FROM FIG. 4A

| | | | |
|---|---|---|---|
| NEAR TELEPHONE | TELEPHONE RING | WHEN TELEPHONE RINGS | SET THE PHONE TO RING ONLY ONCE OR VERY SOFTLY SO THE PHONE DOES NOT CONTINUE TO DISTURB EVERYONE IN THE HOUSE. SEND ALERT TO WHOEVER WANTS TO ANSWER THE PHONE. IF PHONE INCLUDES DISTINCTIVE RING, THE ALERT CAN SEND TO A SEPARATE INDIVIDUAL, OR AT LEAST COMMUNICATE THE INFORMATION OF THE RING |
| NEAR DOORBELL | DOORBELL | WHEN DOORBELL RINGS | SET THE DOORBELL TO RING VERY SOFTLY SO THAT IT DOES NOT DISTURB PEOPLE. SEND ALERT TO PARENT'S DEVICES |
| INSIDE MAILBOX | BOX CLOSURE AND RUSTLING | WHEN BOX IS CLOSED OR ENVELOPES, MAGAZINES, ETC. CAUSE RUSTLING | SEND AN INSTANT MESSAGE OR EMAIL THAT MAIL DELIVERY HAS HAPPENED |
| GARAGE | GARAGE DOOR MOVING AND GARAGE DOOR LOCK | 1. WHEN GARAGE DOOR OPENS AND CLOSES. 2. WHEN GARAGE DOOR IS LOCKED OR UNLOCKED | IF IN THE MIDDLE OF THE NIGHT, SEND PAGE TO PARENTS. KEEP TRACK OF CURRENT DOOR STATUS (OPEN OR CLOSED AND LOCKED OR UNLOCKED), ACCESSIBLE VIA A WEB SERVER OR WITH ALERTS IF OPEN OR UNLOCKED STATE CONTINUE FOR A PERIOD OF TIME |

TO FIG. 4C 401 403 405 407

*FIG. 4C*

FROM FIG. 4B

| | | | |
|---|---|---|---|
| YARD | SPRINKLER SYSTEM ON AND DOG BARKING | WHEN SPRINKLER SYSTEM IS ON FOR TOO LONG A PERIOD OR DOG IS BARKING FOR MORE THAN WHAT NEIGHBORS WILL MIND | SEND ALERT TO HOUSE OWNER'S PDA. LOG RUNTIME TO A WEB SERVER |
| COMPUTER | INCOMING EMAIL, INSTANT MESSAGING, OR CALENDAR ALERT SOUNDS. INSTALLATION FINISH SOUND (SUCH AS BEEP OR OPERATING SYSTEM BOOT SOUND) | 1. WHEN AN INCOMING MESSAGE ARRIVES. 2. WHEN A LENGTHY INSTALL PROCESS COMPLETES | SEND ALERT TO TVs AND COMPUTERS IN HOUSE |
| FAMILY ROOM | VACUUM CLEANER | WHEN VACUUM RUNS IN ROOM | LOG EVENTS AND ALERT BY EMAIL IF THE VACUUM HAS NOT BEEN RUN IN A ROOM FOR A PERIOD OF TIME |
| 401 | 403 | 405 | 407 |

METHOD FOR DISTRIBUTED SOUND COLLECTION AND EVENT TRIGGERING

BACKGROUND OF THE INVENTION

1. Field of the Invention

The present invention relates generally to an improved data processing system, and in particular to method and apparatus for processing events. Still more particularly, the present invention relates to computer implemented method, apparatus, and computer usable program code for collecting and processing audio events.

2. Description of the Related Art

Currently, alarm manufacturers employ a simplistic mechanism to send an alarm to a central office based on a received sound. Alarm manufacturers create a four-device system. A glass-break detector detects the characteristic sound of glass being broken. The glass-break detector operates a modem to dial up a central office, usually operated by an alarm monitoring company. The central office has one or more modems that receive the call and accept information from the sending modem that identifies the type of alarm. The central office uses a user interface to show the alarm with pertinent details concerning the home or office location having the alarm.

Another common configuration of a home alarm is to make a telephone call to a phone number designated by the owner of the home or office having the alarm system. A glass-break detector may detect the characteristic sound. A controller operates in coordination with the detector. The controller operates a telephony device to seize the telephone line and start a call to the designated phone number. Once a voice circuit is completed, the glass-break detector plays a recorded message.

A drawback of the first system is that the system requires an operating telephone line in order to function. Secondly, the glass-break detector operates only with a low-sound filter and a high-sound filter to signal the occurrence of only the sounds that match the glass-breaking sound pattern.

In addition, this type of system is not capable of receiving remote configuration commands. Rather, the controller provides a keypad or other input device where a user may change alarm codes or designated telephone numbers. This shortcoming makes it difficult in instances when an owner does not have access to a phone, but still has access to devices such as a pager. In this situation, the user is unable to redirect notices to a preferred device.

SUMMARY OF THE INVENTION

The present invention provides a computer implemented method for sending alerts. A distributed sensor receives a sound and determines whether the sound matches a preset criterion. If so, the distributed sensor transmits an event to a central portal device.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIGS. 4A through 4C are a table stored in the central portal device to determine what further processing should be done to an event in accordance with an illustrative embodiment;

DETAILED DESCRIPTION OF THE PREFERRED EMBODIMENT

Figure 1:
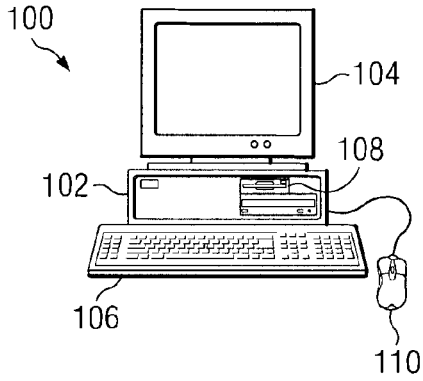
FIG. 1 is a data processing system in accordance with an illustrative embodiment.

With reference now to the figures and in particular with reference to FIG. 1, a pictorial representation of a data processing system in which illustrative embodiments may be implemented. A computer 100 is depicted which includes system unit 102, video display terminal 104, keyboard 106, storage devices 108, which may include floppy drives and other types of permanent and removable storage media, and mouse 110. Additional input devices may be included with personal computer 100, such as, for example, a joystick, touchpad, touch screen, trackball, microphone, and the like. Computer 100 can be implemented using any suitable computer, such as an IBM eServer computer or IntelliStation computer, which are products of International Business Machines Corporation, located in Armonk, N.Y. Although the depicted representation shows a computer, other embodiments may be implemented in other types of data processing systems, such as a network computer. Computer 100 also preferably includes a graphical user interface (GUI) that may be implemented by means of systems software residing in computer readable media in operation within computer 100.

Figure 2:
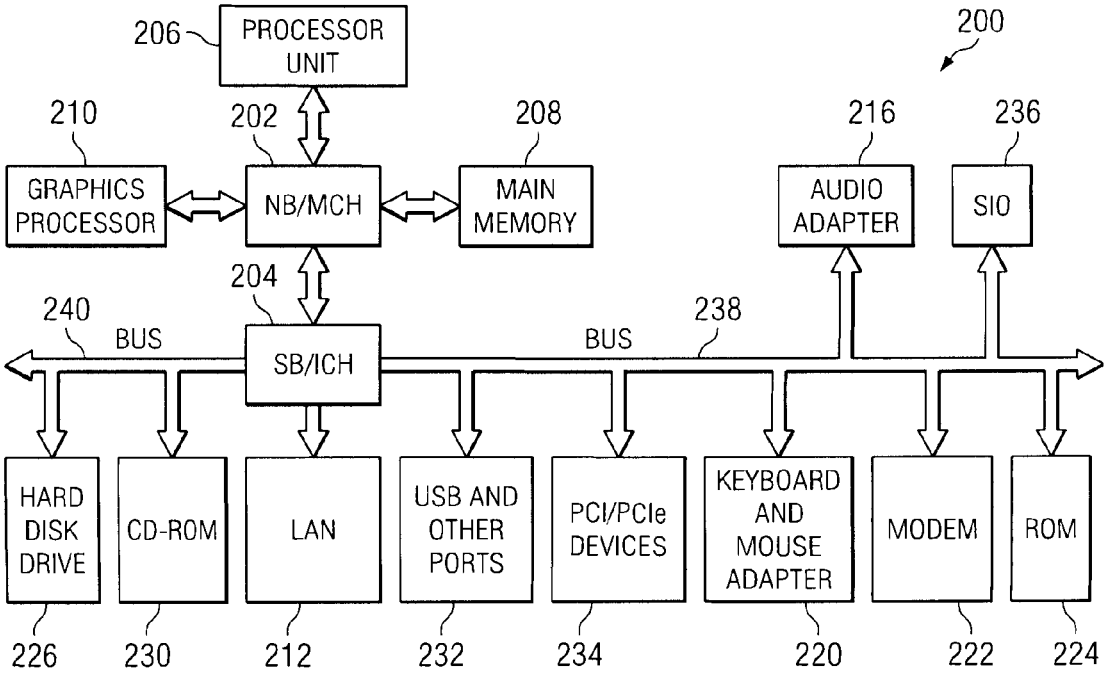
FIG. 2 is a block diagram of a data processing system in accordance with an illustrative embodiment.

With reference now to FIG. 2, a block diagram of a data processing system is shown in which embodiments may be implemented. Data processing system 200 is an example of a computer, such as computer 100 in FIG. 1, in which code or instructions implementing the illustrative embodiment processes may be located. In the depicted example, data processing system 200 employs a hub architecture including a north bridge and memory controller hub (MCH) 202 and a south bridge and input/output (I/O) controller hub (ICH) 204. Processor 206, main memory 208, and graphics processor 210 are connected to north bridge and memory controller hub 202. Graphics processor 210 may be connected to the MCH through an accelerated graphics port (AGP), for example.

In the depicted example, local area network (LAN) adapter 212 connects to south bridge and I/O controller hub 204 and audio adapter 216, keyboard and mouse adapter 220, modem 222, read only memory (ROM) 224, hard disk drive (HDD) 226, CD-ROM drive 230, universal serial bus (USB) ports and other communications ports 232, and PCI/PCIe devices 234 connect to south bridge and I/O controller hub 204 through bus 238 and bus 240. PCI/PCIe devices may include, for example, Ethernet adapters, add-in cards, and PC cards for notebook computers. PCI uses a card bus controller, while PCIe does not. ROM 224 may be, for example, a flash binary input/output system (BIOS). Hard disk drive 226 and CD-ROM drive 230 may use, for example, an integrated drive electronics (IDE) or serial advanced technology attachment (SATA) interface. A super I/O (SIO) device 236 may be connected to south bridge and I/O controller hub 204.

An operating system runs on processor 206 and coordinates and provides control of various components within data processing system 200 in FIG. 2. The operating system may be a commercially available operating system such as Microsoft® Windows® XP. Microsoft and Windows are trademarks of Microsoft Corporation in the United States, other countries, or both. An object oriented programming system, such as the Java™ programming system, may run in conjunction with the operating system and provides calls to the operating system from Java programs or applications executing on data processing system 200. Java is a trademark of Sun Microsystems, Inc. in the United States, other countries, or both.

Instructions for the operating system, the object-oriented programming system, and applications or programs are located on storage devices, such as hard disk drive 226, and may be loaded into main memory 208 for execution by processor 206. The processes of the illustrative embodiments are performed by processor 206 using computer implemented instructions, which may be located in a memory such as, for example, main memory 208, read only memory 224, or in one or more peripheral devices.

Those of ordinary skill in the art will appreciate that the hardware in FIGS. 1-2 may vary depending on the implementation. Other internal hardware or peripheral devices, such as flash memory, equivalent non-volatile memory, or optical disk drives and the like, may be used in addition to or in place of the hardware depicted in FIGS. 1-2. Also, the processes of the illustrative embodiments may be applied to a multiprocessor data processing system.

In some illustrative examples, data processing system 200 may be a personal digital assistant (PDA), which is configured with flash memory to provide non-volatile memory for storing operating system files and/or user-generated data. A bus system may be comprised of one or more buses, such as a system bus, an I/O bus and a PCI bus. Of course, the bus system may be implemented using any type of communications fabric or architecture that provides for a transfer of data between different components or devices attached to the fabric or architecture. A communications unit may include one or more devices used to transmit and receive data, such as a modem or a network adapter. A memory may be, for example, main memory 208 or a cache such as found in north bridge and memory controller hub 202. A processing unit may include one or more processors or CPUs. The depicted examples in FIGS. 1-2 and above-described examples are not meant to imply architectural limitations. For example, data processing system 200 also may be a tablet computer, laptop computer, or telephone device in addition to taking the form of a PDA.

The aspects of the illustrative embodiments provide a computer implemented method, apparatus and computer usable program code for receiving sound and classifying the sound among several events. A processor determines that the received sound meets a preset criterion and transmits an alert to the central portal device in response to the determination. A preset criterion is one or more criteria that govern whether to send an event. A preset criterion includes measuring that a sound is at a certain frequency and above a certain level.

Figure 3:
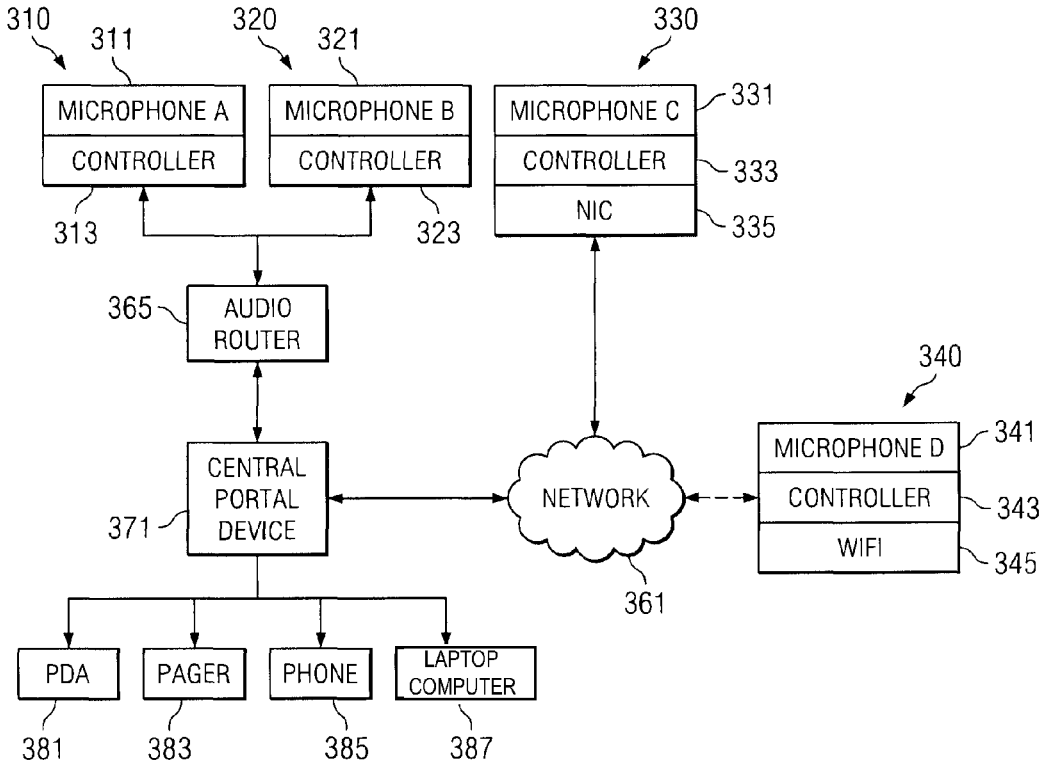
FIG. 3 is a block diagram of a system of distributed sensors in accordance with an illustrative embodiment.

FIG. 3 is a block diagram of a system of distributed sensors in accordance with an illustrative embodiment. FIG. 3 shows various kinds of distributed sensors. A distributed sensor is a sensor that includes, in these examples, a microphone, a controller, and a means to communicate. Distributed sensor A 310 comprises microphone 311 coupled to controller 313. Distributed sensor B 320 comprises microphone 321 coupled to controller 323. Distributed sensor C 330 comprises microphone 331 coupled to controller 333, wherein network interface card 335 provides connectivity to network 361. Distributed sensor D 340 comprises microphone 341 coupled to controller 343, wherein wireless fidelity card 345 provides connectivity to network 361. Wireless fidelity card 345 may include an antenna and support the Institute of Electrical and Electronics Engineers 802.11 series of standards, among others. A microphone may be isotropic, thus receiving sound equally well in all directions. A microphone may be unidirectional, thus unidirectionally receiving sound.

Network 361 may operate according to Ethernet® and include nodes that have access points that support, for example, Institute of Electronics and Electrical Engineers 802.11 series of standards. Ethernet® is a registered trademark of Xerox Corporation. Network 361 may be a network of networks, for example, the Internet.

Each controller may include features of a data processing system, for example, data processing system 200 of FIG. 2. However, to minimize size and cost, redundant aspects may not be required, such as hard disk drive 226, CD-ROM 230, USB 232, PCI/PCIe devices 234, keyboard and mouse adapter 220, modem 222, graphics processor 210 and serial input/output 236.

Distributed sensor A 310 and distributed sensor B 320 may use audio router 365 to interconnect to central portal device or server 371. Audio router 365 is premises wiring, for example, twisted-pair wires suited for audio connections [telephone connections, if present, are in 371]. Central portal device 371 is, for example, an instance of data processing system 200 of FIG. 2. A central portal device is a server or receiver that directly or indirectly receives a signal or event. The signal has a distributed sensor identification, and a sound identification. The central portal device further processes the distributed sensor identification and sound identification. Further processing may include sending the sound as an alert to a user device. A user device is a device having wireless or wired communication that a user identifies or defines to a central portal device as one of perhaps several user devices used by the user. Further processing may also include sending information about the sound as an alert to a user device. Information about the sound is interpretation of the sound event, as opposed to a recording of the sound itself. Information about the sound includes, for example, sending text such as, "Clothes dryer stopped at 8:32 pm."

Central Portal device 371 keeps records concerning which among several devices a user owns and may have selected from time to time. When central portal device 371 receives an event, the central portal device further processes the event to dispatch an alert or message in a form selected by the user. The event is a signal that includes a unique identifier of the distributed device. The event may include additional information, for example, the time the event occurred and even the sound that is or was detected by the distributed device. On the other hand, an alert is a unique identifier or convenient mnemonic string or picture to indicate the nature of the alert and its origins. The alert may be rendered or displayed as a text message, an audible message, or a tactile message, for example, as may occur by vibrating a device in a pattern, for example, Morse code. Central portal device 371 selects among user devices, for example, personal digital assistant (PDA) 381, pager 383, phone 385, and laptop computer 387. Each such user device may have an intermediary proxy device or other networked device, for example, a cellular base transceiver system, to route indirectly such messages to the applicable device.

FIGS. 4A through 4C are a table stored in the central portal device to determine what further processing should be done to an event. The central portal device may have additional rules to correlate a distributed sensor identifier with a name in microphone column 401. Pattern column 403 is a preset criterion that may match the sound identification of the event received by a central portal device, for example, central portal device 371 of FIG. 3. Criteria column 405 is one or more additional criteria that trigger a further action by central portal device 371. Device column 407 indicates which device, for example, a pager, to direct any follow-up alerts.

Figure 5:
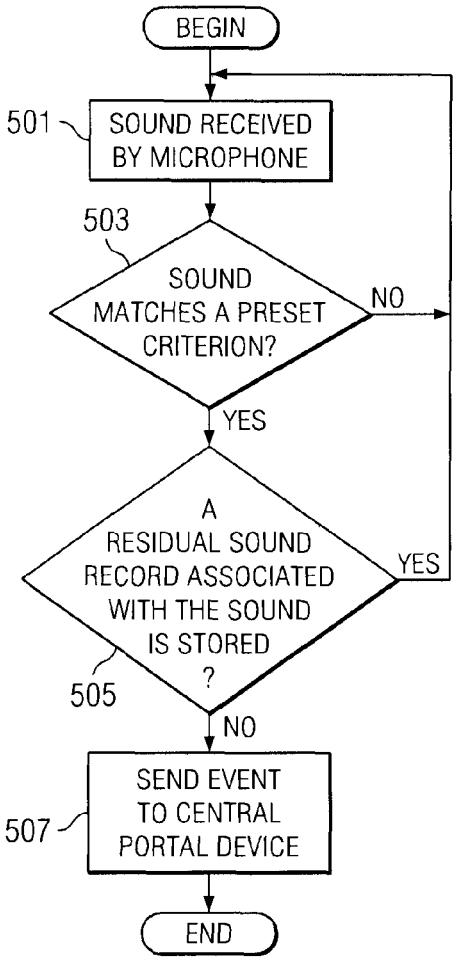
FIG. 5 is a flow chart of steps occurring in a distributed sensor in accordance with an illustrative embodiment.

FIG. 5 is a flowchart of steps occurring in a distributed sensor in accordance with an illustrative embodiment. Steps shown herein are with reference to a distributed sensor, for example, distributed sensor C 330 of FIG. 3. A microphone receives a sound (step 501). The controller analyzes and determines whether the sound matches a preset criterion (step 503). A preset criterion is one or more conditions, including the beginning or ending of a characteristic sound. A preset criterion may include a duration. Controller may detect the preset criterion, in part, using digital filtering techniques to analyze the audio frequency spectrum.

The controller determines whether a residual sound record associated with the sound is stored (step 505). A residual sound record is an indicator that a sound, meeting a frequency pattern, occurred within a period. The residual sound record includes time information, for example, a time-out value associated with a frequency pattern may be set when the sound last occurred, and may expire after a preset duration. Thus, the time-out value, by virtue of being associated with the sound, is a residual sound record associated with the sound. When the time-out value expires, the residual time record is unstored or otherwise unallocated for the reason that time information ceases to be available.

An alternate form of a residual sound record is a pair of fields associated together. The first field is a sound identification for frequency information that the sound matches. A sound identifier is an identifier that is associated with a preset criterion, such as an envelope of frequency levels. The second field is a time at which the match occurred. A hysteresis period is a period that follows the identification or matching of a sound, wherein a device disregards further matches, and the device inhibits making further alerts or responses to the apparently same sound. The hysteresis period completes after a preset period expires following the last matched comparison of the sound.

If at step 505, the controller determines that a residual sound record associated with the sound is stored, the controller continues at step 501. If, however, the controller determines a residual sound record associated with the sound is unstored, controller sends an event to the central portal device (step 507). The event is, for example, a distributed sensor identifier and a sound identifier. A distributed sensor identifier is an identifier that is unique among a set of distributed sensors and a common server or receiver with which the set can communicate, for example, a media access control address.

Figure 6:
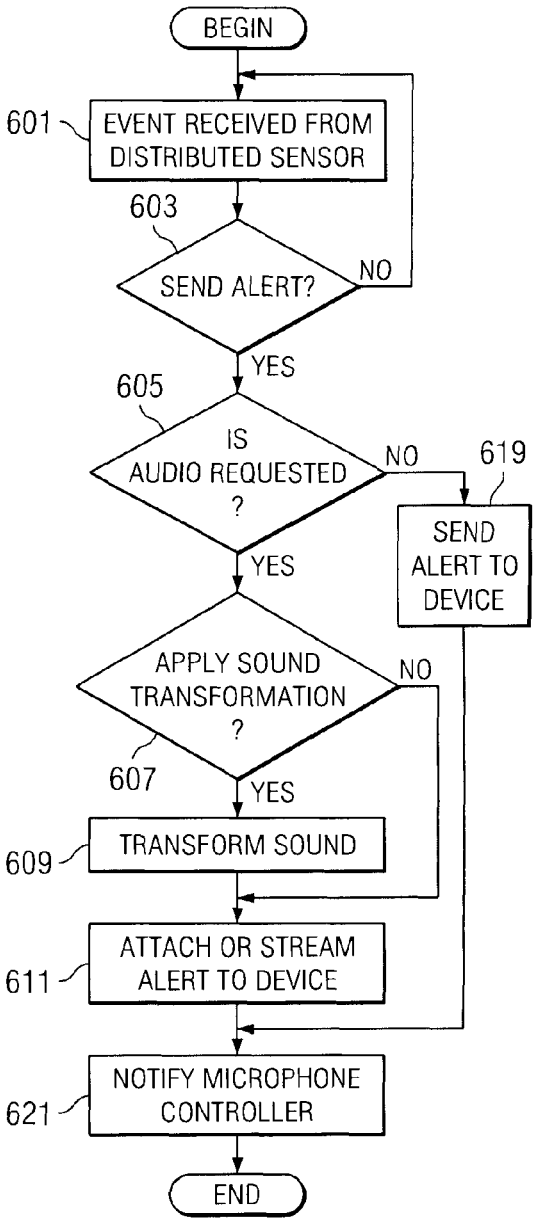
FIG. 6 is a flow chart of steps occurring in a central portal device in accordance with an illustrative embodiment.

FIG. 6 is a flow chart of steps occurring in a central portal device in accordance with an illustrative embodiment. The central portal device receives an event from a distributed sensor (step 601). The central portal device determines if an alert or message is to be sent (step 603). An alert is a signal that identifies one or more of, the distributed sensor identifier, sound identifier, and the circumstances of the sound detected. The central portal device applies rules, for example, from device column 407 of FIGS. 4A through 4C.

The central portal device may have additional rules to correlate a distributed sensor identifier with a name in microphone column 401 of FIGS. 4A through 4C. The central portal device determines whether to send an alert (step 603). The central portal device makes this determination by applying the rule that the central portal device looks up under criteria column 405 based on the field looked up using microphone column 401. If the determination is negative, the central portal device resumes processing at step 601. A positive determination causes the central portal device to determine if audio is requested (step 605). In other words, audio is requested when an alert should include audio. The central portal device makes this determination when the central portal device looks-up device column 407 information. The lookup is based on the distributed sensor identifier or mnemonic. For example, distributed sensor identifier 409 is "Near a creaky floor or stair." A lookup to device column 407 shows an instruction to record sounds.

Central portal device 371 may be adapted to receive configuration commands via, for example, a hypertext markup language compliant website. The website may be hosted by the central portal device or by a network accessible device. A user may edit the table of FIGS. 4A through 4C by means of filling in fields in a hypertext markup language form, or by editing a flat text file that defines each cell of a row in the table.

If the central portal device determines that audio is to be included, the central portal device further determines whether to apply a sound transformation to the audio (step 607). A sound transformation is a process, wherein the central portal device applies an equalizer filter to one or more frequency bands. The sound transformation may include the central portal device shifting an audio frequency to a user-selected frequency. For example, the central portal device may transform high frequencies to low frequencies that an elderly person might hear well. A positive determination to step 607 results in the central portal device transforming the sound (step 609). Regardless of the determination to step 607, the central portal device attaches or otherwise streams the sound, with any applicable transformation, as an alert to the user device (step 611).

A negative determination to step 605 results in the central portal device sending an alert to the user device (step 619). Processing from steps 611 and 619 converges when the central portal device notifies the distributed sensor that an action from the table was performed (step 621). The step of notifying includes sending a reset instruction. A reset instruction is an instruction to send to a particular microphone or microphones when to resume alerting, such as immediately, and, optionally, to cease streaming audio. The process terminates thereafter. An alternative to step 621 is that the central portal device logs the event to a log.

The illustrative embodiments provide a computer implemented method, apparatus and computer usable program code for collecting sounds and alerting aspects concerning the sounds to a device. A central portal device evaluates sounds and confirms that no recent sound occurred in order to avoid redundant alerts. A positive determination means that the central portal device will dispatch an alert according to the preferences and circumstances of the user, as recorded to, for example, a table. Consequently, a user may choose a device to receive a particular kind of alert at such times the user prefers and supplying audio information as required by the user.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any tangible apparatus that can contain, store, communicate, or transport the program for use by or in connection with the instruction execution system, apparatus, or device.

The medium can be an electronic, magnetic, optical, electromagnetic, infrared, or semiconductor system (or apparatus or device). Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-RIW) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A method in a distributed sensor for sending alerts comprising:

responsive to detecting a sound with the distributed sensor, determining whether the sound matches a preset criterion, wherein the preset criterion includes the beginning or ending of a characteristic sound, and wherein the distributed sensor includes a microphone, a controller and means to communicate;

transmitting an event to a central portal device for processing in response to determining that the sound matches the preset criterion, wherein the event is a signal that includes a distributed sensor identification, and sound identification; and sending an alert to a user device wherein an alert includes a sound alert, a string or picture that indicates nature and origin of the alert, and wherein the user device includes at least one of a personal digital assistant, a phone, a pager, or a laptop computer, wherein the alert can be rendered on the user device as at least one of a text message or an audible message.

2. The method of claim 1 wherein determining further comprises:

determining that a residual sound record associated with the sound is unstored.

3. The method of claim 2 wherein the residual sound record includes time information originating within a period.

4. The method of claim 1, wherein the microphone receives a sound, and wherein receiving the sound comprises isotropically or unidirectionally receiving the sound.

5. The method of claim 1 further comprising the steps:

determining if audio is requested; and transmitting the audio in response to the determination that audio is requested.

6. A tangible computer storage medium having a computer program product encoded thereon, the computer program product including computer usable program code for reporting an event, the tangible computer storage medium comprising:

computer usable program code, responsive to detecting a sound with a distributed sensor, for determining whether the sound matches a preset criterion, wherein the preset criterion includes the beginning or ending of a characteristic sound, and wherein the distributed sensor includes a microphone, a controller and means to communicate;

computer usable program code for transmitting an event to a central portal device for processing in response to determining that the sound matches the preset criterion, wherein the event is a signal that includes a distributed sensor identification, and sound identification; and computer usable program code for sending an alert to a user device, wherein an alert includes a sound alert, a string or picture that indicates nature and origin of the alert, and wherein the user device includes at least one of a personal digital assistant, a phone, a pager, or a laptop computer, wherein the alert can be rendered on the user device as at least one of a text message or an audible message.

7. The tangible computer storage medium of claim 6 wherein determining further comprises:

computer usable program code for determining that a residual sound record associated with the sound is unstored.

8. The tangible computer storage medium of claim 7 wherein the residual sound record includes time information originating within a period.

9. The tangible computer storage medium of claim 6 further comprising:

computer usable program code for isotropically receiving or unidirectionally receiving a sound at the microphone.

10. The tangible computer storage medium of claim 6 further comprising:

computer usable program code for determining if audio is requested; and computer usable program code for transmitting the audio in response to the determination that audio is requested.

11. A data processing system comprising:

a storage containing computer usable program code for reporting an event;

a bus system connecting the storage to a processor; and a processor, wherein the processor executes the computer usable program code, responsive to detecting a sound with a distributed sensor, to determine whether the sound matches a preset criterion, wherein the preset criterion includes the beginning or ending of a characteristic sound, and wherein the distributed sensor includes a microphone, a controller and means to communicate; to transmit an event to a central portal device for processing in response to determining that the sound matches the preset criterion, wherein the event is a signal that includes a distributed sensor identification, and sound identification; and to send an alert to a user device, wherein an alert includes a sound alert, a string or picture that indicates nature and origin of the alert, and wherein the user device includes at least one of a personal digital assistant, a phone, a pager, or a laptop computer, wherein the alert can be rendered on the user device as at least one of a text message or an audible message.

12. The data processing system of claim 11 wherein the processor executes the computer usable program code:

to determine that a residual sound record associated with the sound is unstored.

13. The data processing system of claim 12 wherein the residual sound record includes time information originating within a period.

14. The data processing system of claim 11 wherein the processor executes the computer usable program code:

to isotropically receive or unidirectionally receive a sound at the microphone.

15. The data processing system of claim 11 wherein the processor executes the computer usable program code:

to determine if audio is requested; and to transmit the audio in response to the determination that audio is requested.

* * * * *